US008522413B2

(12) United States Patent
Van't Oever et al.

(10) Patent No.: US 8,522,413 B2
(45) Date of Patent: Sep. 3, 2013

(54) DEVICE AND METHOD FOR FLUIDIC COUPLING OF FLUIDIC CONDUITS TO A MICROFLUIDIC CHIP, AND UNCOUPLING THEREOF

(75) Inventors: Ronny Van't Oever, Deventer (NL); Marko Theodoor Blom, Enschede (NL); Wilfred Buesink, Hengelo (NL)

(73) Assignee: Micronit Microfluids B.V., Enschede (NL)

( * ) Notice: Subject to any disclaimer, the term of this patent is extended or adjusted under 35 U.S.C. 154(b) by 879 days.

(21) Appl. No.: 12/666,497

(22) PCT Filed: Jun. 23, 2008

(86) PCT No.: PCT/NL2008/000156

§ 371 (c)(1), (2), (4) Date: Dec. 23, 2009

(87) PCT Pub. No.: WO2009/002152

PCT Pub. Date: Dec. 31, 2008

(65) Prior Publication Data

US 2010/0320748 A1 Dec. 23, 2010

(30) Foreign Application Priority Data

Jun. 26, 2007 (NL) ..... 1034038

(51) Int. Cl.

| | |
|---|---|
| ***B25B 27/04*** | (2006.01) |
| ***B25B 31/00*** | (2006.01) |
| ***B25B 27/10*** | (2006.01) |
| ***B25B 27/02*** | (2006.01) |
| ***E02D 5/16*** | (2006.01) |
| ***B01L 3/00*** | (2006.01) |

(52) U.S. Cl.

USPC ..... 29/282; 29/243.56; 29/237; 29/238; 29/243.5; 29/278; 29/283.5; 29/281.6; 269/903; 422/502; 422/503

(58) Field of Classification Search

USPC ..... 29/282, 243.56, 237, 238, 243.5, 29/278, 283.5, 281.6; 269/903; 422/502–503

See application file for complete search history.

(56) References Cited

U.S. PATENT DOCUMENTS 4,524,501 A * 6/1985 Pringle ..... 29/237
5,964,239 A 10/1999 Loux et al.

(Continued)

FOREIGN PATENT DOCUMENTS

EP 1 577 012 A1 9/2005
GB 2 421 202 A 6/2006

(Continued)

*Primary Examiner* — Lee D Wilson
*Assistant Examiner* — Nirvana Deonauth
(74) *Attorney, Agent, or Firm* — The Webb Law Firm

(57) ABSTRACT

A system for fluidic coupling and uncoupling of fluidic conduits and a microfluidic chip, wherein the fluidic conduits are connected mechanically to a first structural part and the microfluidic chip is carried by a second structural part. The structural parts are moved perpendicularly toward and away from each other by means of a mechanism provided for this purpose. Outer ends of the fluidic conduits can thus be moved over a determined distance substantially perpendicularly to the outer surface of the microfluidic chip and connecting openings in the outer surface of the microfluidic chip. This enables accurate realization of fluidic coupling and uncoupling without the occurrence of undesirable moments of force and with minimal risk of damage to the fluidic conduits or the connecting openings. With such system requirements which can be set in respect of convenience, speed, temperature resistance, sealing, chemical resistance, reproducibility and so forth, can be fulfilled.

28 Claims, 5 Drawing Sheets

(56) References Cited

U.S. PATENT DOCUMENTS

| | | | | |
|---|---|---|---|---|
| 5,989,402 | A | 11/1999 | Chow et al. | |
| 6,319,476 | B1 | 11/2001 | Victor, Jr. et al. | |
| 6,324,884 | B1 * | 12/2001 | Barjesteh et al. | 72/402 |
| 6,399,023 | B1 | 6/2002 | Chow | |
| 6,811,668 | B1 | 11/2004 | Berndt et al. | |
| 6,926,313 | B1 | 8/2005 | Renzi | |
| 7,144,003 | B1 * | 12/2006 | Meade | 269/43 |
| 2002/0009392 | A1 | 1/2002 | Wolk et al. | |
| 2003/0129756 | A1 | 7/2003 | Thorne, IV et al. | |
| 2004/0101444 | A1 | 5/2004 | Sommers et al. | |
| 2004/0157336 | A1 | 8/2004 | Petroff et al. | |
| 2005/0158209 | A1 * | 7/2005 | Bender et al. | 422/99 |
| 2007/0297947 | A1 | 12/2007 | Sommers et al. | |

FOREIGN PATENT DOCUMENTS

| | | | |
|---|---|---|---|
| WO | 00/77511 | A1 | 12/2000 |
| WO | 00/78454 | A1 | 12/2000 |
| WO | 01/14064 | A1 | 3/2001 |
| WO | 01/89681 | A2 | 11/2001 |
| WO | 03/076063 | A1 | 9/2003 |
| WO | 2006/103440 | A2 | 10/2006 |
| WO | 2007/016931 | A1 | 2/2007 |

* cited by examiner

DEVICE AND METHOD FOR FLUIDIC COUPLING OF FLUIDIC CONDUITS TO A MICROFLUIDIC CHIP, AND UNCOUPLING THEREOF

FIELD OF THE INVENTION

The invention relates to a device for fluidic coupling of fluidic conduits to a microfluidic chip, and uncoupling thereof, which device comprises a first structural part to which the fluidic conduits can be mechanically coupled and a second structural part which can carry the microfluidic chip. The invention also relates to a method for fluidic coupling of fluidic conduits to a microfluidic chip, and uncoupling thereof, which method comprises of:

- mechanically coupling the fluidic conduits to a first structural part; and
- having the microfluidic chip carried by a second structural part.

BACKGROUND OF THE INVENTION

Microfluidics is concerned with microstructural devices and systems with fluidic functions. This may relate to the manipulation of very small quantities of liquid or gas in the order of microliters, nanoliters or even picoliters. Important applications lie in the field of biotechnology, chemical analysis, medical testing, process monitoring and environmental measurements. A more or less complete miniature analysis system or synthesis system can herein be realized on a microchip, a so-called 'lab-on-a-chip', or in specific applications a so-called 'biochip'. The device or the system can comprise microchannels, mixers, reservoirs, diffusion chambers, integrated electrodes, pumps, valves and so forth. The microchip is usually constructed from one or more layers of glass, silicon or a plastic such as a polymer. Glass in particular is highly suitable for many applications due to a number of properties. Glass has been known for many centuries and many types and compositions are readily available at low cost. In addition, glass is hydrophilic, chemically inert, stable, optically transparent, non-porous and suitable for prototyping; properties which in many cases are advantageous or required.

A microfluidic microchip must generally be connected to external fluidic tubes or capillaries. Use can be made here of a chip holder. Such a chip holder with a 'process control device' (sensor or actuator) integrated into the chip holder is described in WO 2007/016931 A1, wherein a chip holder of the present applicant is stated as prior art ([0013], FIGS. 10a and 10b). For the sealing of a connection between a tube or capillary and a microfluidic chip use can be made of a ferrule, a small bracelet commonly used in compression fittings. There are many more other examples of devices and systems wherein external fluidic components are connected to a microfluidic chip. Claimed in US 2003/0129756 A1 is a 'cassette' 5 into which a 'slide' 10 can be moved from the side via an 'opening' 20 and is subsequently pressed by means of a 'leaf spring' 34 against a 'transparent top wall/lens' 18 wherein an 'analytical cavity' 29 is formed. Reagents can then be supplied via 'ports' 42,46 to samples on the 'slide', and be discharged again. In US 2002/0009392 A1 are claimed a method and device for preventing 'fluid carryover/cross-contamination' by 'washing' and/or coating of a 'capillary or pipettor element' 102. Mentioned are [0062] a 'handler' comprising a 'holder' for a 'microfluidic device', and [0071] a 'stage' provided with 'mounting/alignment elements' such as a 'nesting well', 'alignment pins and/or holes' of 'asymmetric edge structures'. U.S. Pat. No. 5,989,402 relates to 'interfacing' of 'microfluidic devices' with 'ancillary systems', in particular to 'electrical interfacing' with 'electrical control systems', with optionally thermal or optical 'interfacing'. Embodiments are claimed for an 'electrically controlled microfluidic system' comprising a 'microfluidic device', an 'electrical control system' and an 'electrical interface array'; and also embodiments of a 'microfluidic system' comprising a 'clam shell' (comprising a 'base' suitable for receiving a 'microfluidic device' and a 'cover' with first 'electrical interface components') and, accommodated in the 'base', a 'microfluidic device' (with second 'electrical interface components' which make contact with the first 'electrical interface components' when the 'clam shell' is closed). Claimed in U.S. Pat. No. 6,399,023 B1 are embodiments of an 'analytical system' and of a method for 'configuring an analytical system'. This relates to the use of an 'adapter' as 'interface' between a '(microfluidic) sample substrate' and an '(analytical) base unit'. Electrical, optical, thermal, acoustic, hydraulic and/or pneumatic signals or energy can be exchanged between the components. In U.S. Pat. No. 6,811,668 B1 a system is claimed comprising a 'first physical unit' (which can accommodate a 'microfluidic device') and at least one 'second physical unit' (comprising a 'material transport system' with at least one 'first interface component'), wherein via the 'first interface component' the 'material transport system' 'provides a (electrical, pressure, thermal, . . . ) potential' to the 'microfluidic device' in order to bring about material transport in the 'microfluidic device'. Described in U.S. Pat. No. 5,964,239 is a 'housing for a (silicon) micromachined body' comprising a 'top plate' and a 'bottom plate', with 'tubes' attached thereto by means of adhesives and/or 'ferrule-nut type connectors'. The 'plates' and 'body' are pressed onto each other by means of a 'spring clamp'. Shown in US 2007/0297947 A1, FIGS. 1, 23, 24, is a 'chip' 100,2400 in a 'chipholder' 105 or 'chipcartridge' 2400 which is placed in a 'chip interface subassembly'. Described in US 2004/0157336 A1 is a 'fluidics station' 141 comprising a 'housing' 410 for receiving a 'removable module' 405 which in his turn comprises a 'holder' 300 for receiving a 'probe array cartridge' 200. Described in EP 1577012 A1 is a 'microfluidic device' 1 comprising a 'frame' 2 for receiving a 'microfluidic chip' 3. The whole is used together with a 'laboratory apparatus'. Described in WO 2006/103440 A2 is an analysis apparatus provided with a 'docking mechanism' for one or more 'cartridges' comprising a 'clamping mechanism', wherein upon placing of a 'cartridge' fluidic connections (by means of ferrules) as well as electrical connections are realized between apparatus and 'cartridge'. Other solutions for connecting a microfluidic chip to an apparatus, tubes or capillaries are described in WO 03/076063 A1, US 2004/0101444 A1, U.S. Pat. No. 6,319,476 B1, WO 01/89681 A2, WO 00/77511 A1, WO 00/78454 A1 and WO 01/14064 A1.

All the stated solutions at least partially do not meet the requirements which can be set in respect of convenience of use, speed of operation, temperature resistance, sealing, chemical resistance, reproducibility and so forth. There is therefore a need for a technical solution which does fulfil said requirements. The invention has for its object to meet this need.

SUMMARY OF THE INVENTION

The invention provides for this purpose a system for fluidic coupling and uncoupling of fluidic conduits and a microfluidic chip, wherein the fluidic conduits are connected mechanically to a first structural part and the microfluidic chip is carried by a second structural part. 'Fluidic conduits' can be understood here and in the following to also mean 'fluidic conduit', although there is generally a plurality of fluidic conduits. The first structural part and the second structural part are moved according to the invention perpendicularly toward and away from each other by means of a mechanism according to the invention. Outer ends of the fluidic conduits can thus be moved over a determined distance substantially perpendicularly to an outer surface of the microfluidic chip. The outer ends of the fluidic conduits to be coupled or uncoupled can thus perpendicularly approach or leave connecting openings present in the outer surface of the microfluidic chip, this enabling accurate realization of fluidic couplings and uncouplings without the occurrence of undesirable moments of force and with a minimal risk of damage to the fluidic conduits or the connecting openings. 'Connecting openings' can also be understood here and in the following to mean 'connecting opening', although generally there will be a plurality of connecting openings.

The relative movement of the first structural part and the second structural part is preferably guided by means of guide means, for instance cylindrical guides and recesses co-acting therewith. 'Cylindrical guides' and 'recesses' can be understood here and in the following to also mean respectively 'cylindrical guide' and 'recess', although there will generally be a plurality of cylindrical guides and recesses. A cylindrical guide can here be arranged on the first structural part and the associated recess on the second structural part, or vice versa. The first structural part and the second structural part are here preferably urged away from each other by means of first urging means, preferably springs. 'Springs' can be understood here and in the following to also mean 'spring', although generally there will be a plurality of springs. Such a construction is found in practice to function very well and to meet the requirements which can be set in respect of convenience of use and speed of operation, control over the relative movement of the structural parts and the precision thereof, and the forces to the produced for the purpose of realizing the required sealing of the fluidic couplings.

Use is preferably made of a removable part with a receiving space for the microfluidic chip. The removable part serves as protection and as an aid in the manipulation and positioning of the microfluidic chip relative to the fluidic conduits, and can slide as a drawer in and out of the other part of the device. The removable part is preferably provided here with protrusions for the purpose of holding apart the outer surface of the microfluidic chip and the outer ends of the fluidic conduits during removal or insertion of the removable part. 'Protrusions' can be understood here and in the following to also mean 'protrusion', although generally there will be a plurality of protrusions. Damage to the microfluidic chip and breakage of the fluidic conduits can thus be prevented.

The first structural part and the second structural part are preferably moved away from and toward each other by means of a lever mechanism. The required manual effort can thus be held within determined limits. The lever mechanism here preferably comprises two shafts rotating in opposite direction and provided with mutually coupled cranks. Such a construction is found in practice to suffice very well for the perpendicular and well controlled movement of the structural parts toward and away from each other. The shafts can here preferably be operated by means of a single handle, this simplifying operation and enhancing convenience of use.

The transmission ratio of the lever mechanism in a first part of the path of the relative movement of the first structural part and the second structural part preferably differs substantially from the transmission ratio in a second part of this path. The lever mechanism can comprise for this purpose a cam which is mechanically connected to one of the structural parts and which co-acts with a part, profiled for this purpose, of the surface of the other structural part. In the first part of the path of mutual approach the structural parts can for instance thus move substantially more quickly relative to each other than in the final part of this path at a speed of movement of the handle which remains the same, while in the final part of the path a greater force can be realized between the structural parts relative to each other with the same manual power. This will be further elucidated in the following description of a preferred embodiment of a device and method according to the invention.

Aligning means, preferably spring-mounted aligning members, preferably balls, and recesses co-acting therewith are preferably provided for the mutual alignment of the outer ends of the fluidic conduits and the microfluidic chip. 'Aligning members', 'balls' and 'recesses' can be understood here and in the following to also mean respectively 'aligning member', 'ball' and 'recess', although generally there will be a plurality of aligning members, balls and recesses. The microfluidic chip and the outer ends of the fluidic conduits can thus be aligned with each other in sufficiently precise manner.

For the purpose of sealing a connection of a fluidic conduit to the microfluidic chip, use is preferably made here of a conical receiving space which is provided for this purpose and in which a sealing member with a corresponding conical outer surface is at least partially received, wherein the sealing member is urged into the conical receiving space by means of second urging means provided for this purpose, preferably a spring. A resilient seal also has the advantage that expansion and contraction, for instance due to thermal loads, can be compensated. Use can be made here of a sealing auxiliary means in which the conical receiving space is arranged. The second urging means are preferably biased. It thus becomes possible to urge the sealing member with a greater force into the conical receiving space. This and other aspects relating to the invention will be further elucidated in the following more detailed description of exemplary embodiments of the invention.

EXEMPLARY EMBODIMENTS OF THE INVENTION

Figure 1:
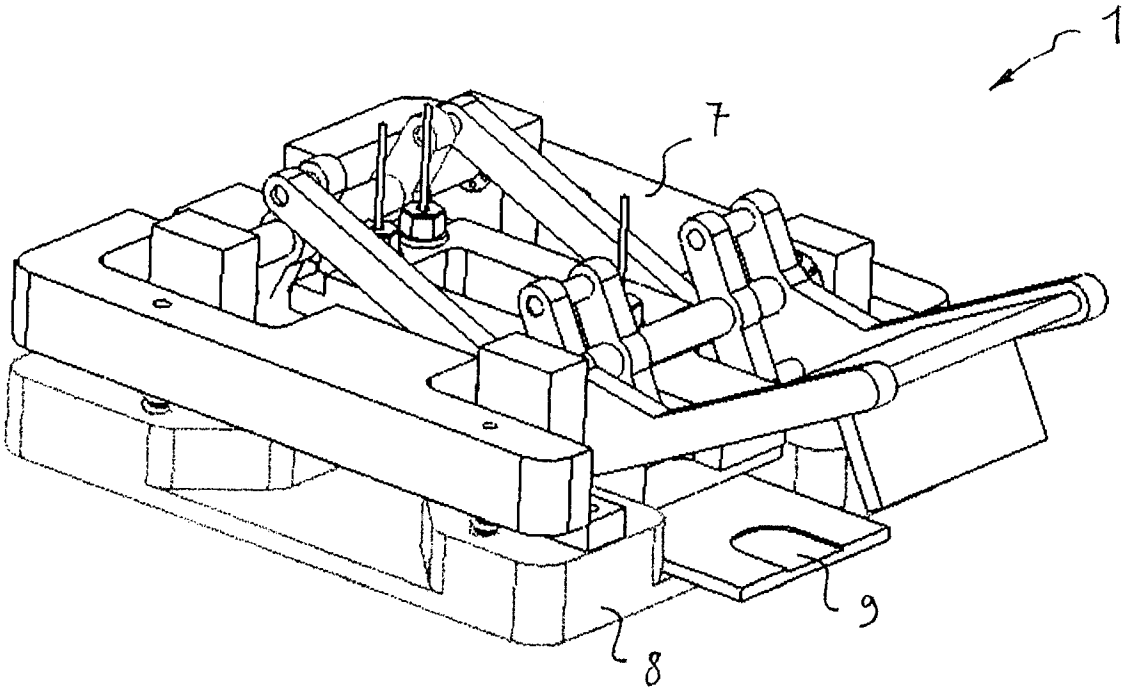
FIG. 1 shows a perspective view of a preferred embodiment of a device according to the invention.

A preferred embodiment of a device (1) according to the invention comprises a first structural part (7) and a second structural part (8) and also a mechanism (4) for mutually perpendicular movement toward and away from each other of first structural part (7) and second structural part (8). Mechanism (4) comprises for this purpose a dual lever mechanism (13) with two shafts (11,12) rotating in opposite directions which are provided with mutually coupled cranks (22) and can be operated by means of a single handle (5). Guide means (19) in the form of cylindrical guides (20) and recesses (21)

co-acting therewith provide for guiding of the relative movement of first structural part (7) and second structural part (8). First structural part (7) and second structural part (8) are urged apart by means of urging means in the form of springs (27). Second structural part (8) comprises a removable part (9) with a receiving space (14) for receiving a microfluidic chip (3). Removable part (9) is provided with protrusions (10). Device (1) also comprises aligning means (15) in the form of spring-mounted balls (16) and recesses (17) co-acting therewith.

Figure 2:
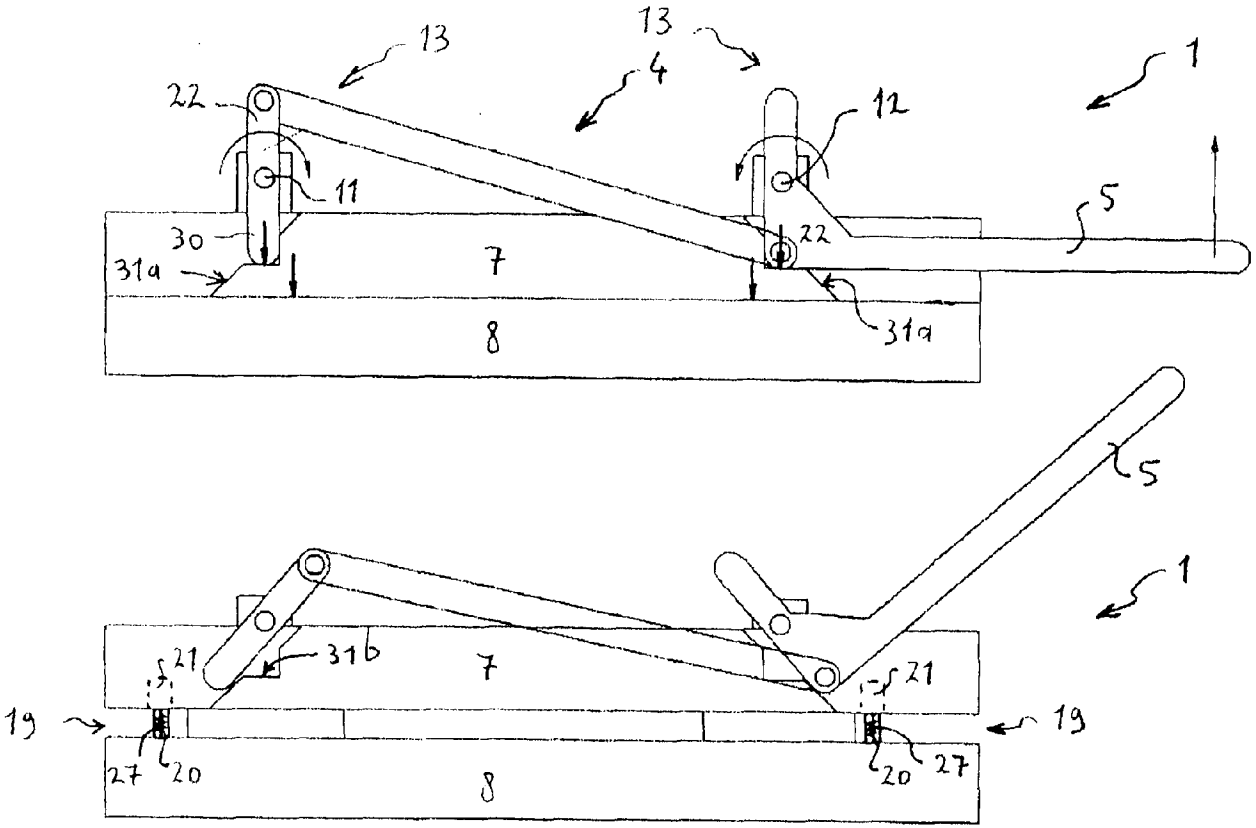
FIG. 2 shows more or less schematic side views thereof in closed and opened position.

For the purpose of connecting fluidic conduits (2,2') to microfluidic chip (3) the fluidic conduits (2,2') are mechanically connected to first structural part (7). Microfluidic chip (3) with an outer surface (6) provided with connecting openings (26,26',26") is placed in receiving space (14) in removable part (9). The removable part (9) with microfluidic chip (3) is then inserted while device (1) is situated in opened position (FIG. 2*a*). The outer surface (6) of microfluidic chip (3) and the outer ends of fluidic conduits (2,2') are here held apart by protrusions (10) on removable part (9).

Device (1) is then closed by pressing handle (5) downward (FIG. 2*b*). Second structural part (8), including removable part (9) and microfluidic chip (3), is herein moved toward first structural part (7), wherein the outer ends of fluidic conduits (2,2') move perpendicularly toward outer surface (6) of microfluidic chip (3). The outer ends of fluidic conduits (2) and microfluidic chip (3) are herein mutually aligned by aligning means (15) and the fluidic couplings are effected.

The transmission ratio of lever mechanism (4) in a first part of the path of the relative movement of first structural part (7) and second structural part (8) differs substantially from the transmission ratio in a second part of this path. In order to bring this about, the rotating shafts (11,12) are provided with cams (30) which co-act with profiled parts (31*a*,31*b*) of the surface of first structural part (7). During closing the structural parts (7,8) will first move more rapidly [cams (30) move along parts (31*a*)] and then more slowly [cams (30) move along parts (31*b*)] toward each other while the speed of movement of handle (5) remains the same. A relatively large mutual displacement of structural parts (7,8) necessary for the insertion or removal of removable part (9) with microfluidic chip (3) can thus be achieved. In the final part of the closing path [cams (30) move along parts (31*b*)] a greater relative force can be realized between structural parts (7,8) with the same manual effort. This is necessary to obtain a good seal of the connections of fluidic conduits (2) to microfluidic chip (3). In the given example there is in the opened situation an opening of 7 mm to enable sliding of removable part (9) with microfluidic chip (3) into device (1). During closing the full force is transmitted to the fluidic seals in the final 1 mm. In this final millimeter the lever action is maximal, whereby sufficient force can be produced.

Figure 3:
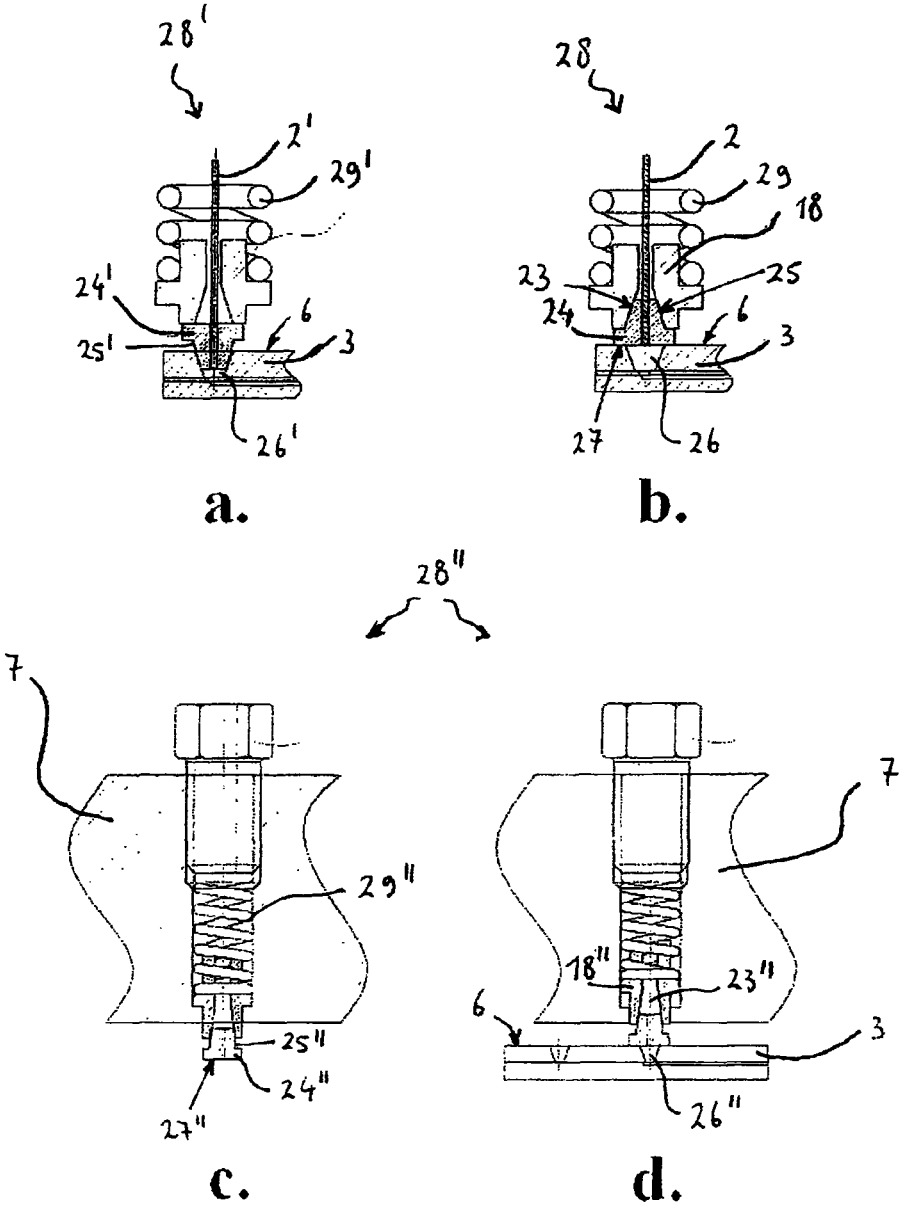
FIG. 3 shows cross-sections of connections of a fluidic conduit to a microfluidic chip according to the invention.
Figure 4:
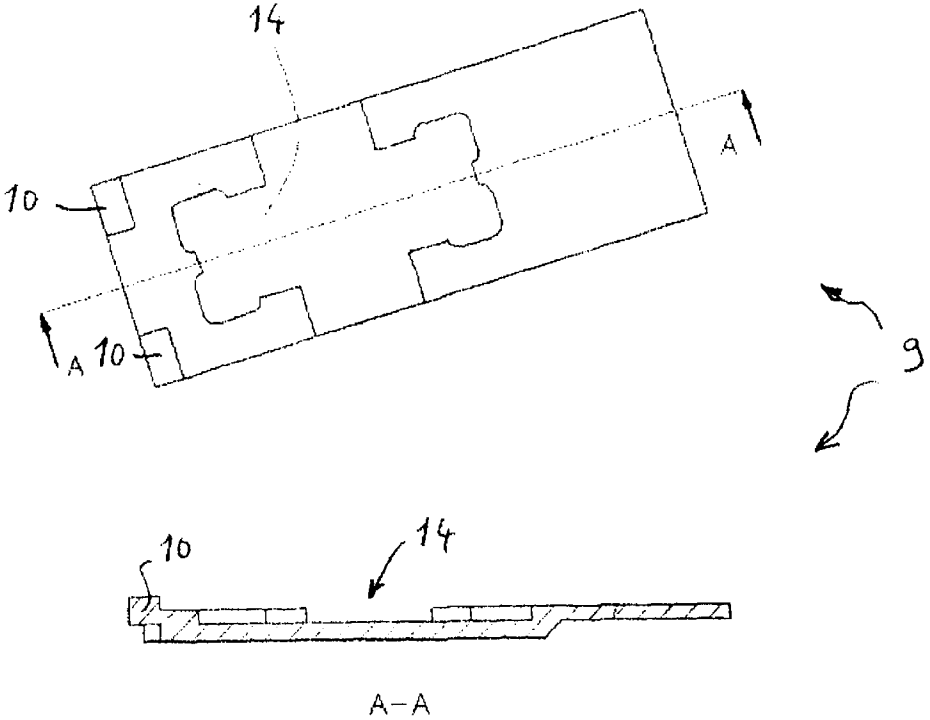
FIG. 4 shows a top view and a cross-section of a removable part according to the invention.
Figure 5:
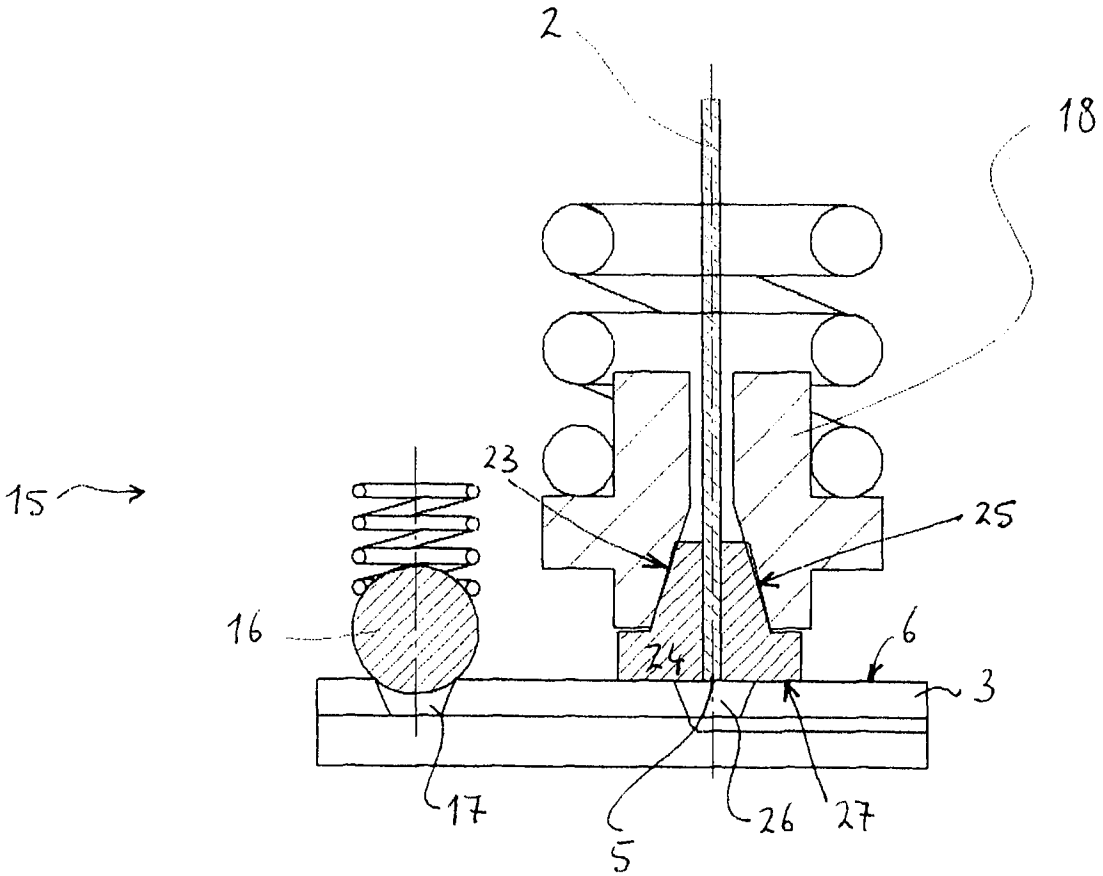
FIG. 5 shows a detail cross-section of aligning means and a connection according to the invention.

For sealing of the connections (28,28',28") of fluidic conduits (2,2') to microfluidic chip (3) use is made of sealing members (24,24',24") with conical outer surfaces (25,25', 25") which are per se known. Such a sealing member (24') can be used in a seal wherein the sealing member (24') is pressed with the conical outer surface (25') into a conical connecting opening (26') in an outer surface (6) of microfluidic chip (FIG. 3*a*). Such a sealing member (24,24") can also be pressed with the conical outer surface (25,25") into a conical receiving space (23,23") provided in a sealing auxiliary means (18,18") (FIG. 3*b*,3*c*,3*d*), wherein the sealing member (24,24") presses with a flat side (27,27") against outer surface (6) of microfluidic chip (3). The dimensions of the sealing member (24,24") and other components of the seal (28,28") and the geometry of connecting opening (26,26") can then be chosen more or less independently of each other. Provided according to the invention are springs (29,29',29") with which sealing members (24,24',24") are pressed respectively into conical receiving space (23,23") and conical connecting opening (26') in order to thus obtain a good seal. A resilient seal moreover has the advantage that expansion and contraction, for instance due to thermal loads, can be compensated. If there is insufficient space for expansion, a sealing member can for instance undergo permanent plastic deformation at higher temperatures. The relevant fluidic connection may then begin to leak after cooling.

The relevant spring (29") is here preferably biased (FIG. 3*c*). During the final part of the closing path the sealing member (24") comes to lie against outer surface (6) of microfluidic chip (3) (FIG. 3*d*), wherein the biased spring (29") is further compressed and thus urges sealing member (24") with a greater force into conical receiving space (23"). This produces a better seal.

Such a system for fluidic coupling and uncoupling of fluidic conduits and a microfluidic chip has the following advantageous features and properties:

- reliable: chip and conduits can be connected and disconnected without problem 100 times or more;
- easy to operate: easy insertion of the microfluidic chip, the device can easily be opened and closed with a single manipulation of the handle with minimal user effort, and the device is easy to assemble and disassemble using a single tool;
- fast: replacing a chip can be done within one minute;
- the microfluidic chip is automatically aligned with the fluidic conduits;
- at least 25×11 $mm^2$ is available for viewing and illumination of the chip;
- microscopic viewing of the chip is possible from a distance of less than 4 mm;
- the chip is protected against breakage during use or assembly of the device;
- sealing is possible up to pressures of 200 bar;
- suitable for temperatures up to 200° C.;
- the connections made show minimal dead volume;
- electrical connections can be integrated into the device.

It will be apparent that the invention is by no means limited to the given exemplary embodiments, but that many variants are possible within the scope of the invention.

The invention claimed is:

1. A device for fluidic coupling of fluidic conduits to a microfluidic chip, and uncoupling thereof, comprising:

- a first structural part to which the fluidic conduits can be mechanically connected;
- a second structural part which can carry the microfluidic chip; and
- a mechanism with which the first structural part and the second structural part can be moved perpendicularly toward and away from each other~
- wherein the mechanism comprises a lever mechanism, and wherein a transmission ratio of the lever mechanism in a first part of a range of a relative movement of the first structural part and the second structural part differs substantially from a transmission ratio in a second part of the range.

2. The device as claimed in claim 1, further comprising guide means with which the relative movement of the first structural part and the second structural part is guided.

3. The device as claimed in claim 2, wherein the guide means comprise a cylindrical guide and a recess co-acting therewith, and wherein the guide is arranged on the first structural part and the recess is arranged in the second structural part.

4. The device as claimed in claim 2, wherein the guide means comprise a cylindrical guide and a recess co-acting therewith, and wherein the guide is arranged on the second structural part and the recess is arranged in the first structural part.

5. The device as claimed in claim 1, further comprising a first urging means, with which the first structural part and the second structural part are urged apart, wherein the first urging means may be first springs.

6. The device as claimed in claim 1, wherein the second structural part comprises a removable part with a receiving space in which the microfluidic chip can be at least partially received.

7. The device as claimed in claim 6, wherein the removable part is provided with protrusions which, after the microfluidic chip is received in the receiving space, protrude above the surface of the microfluidic chip directed toward the fluidic conduits.

8. The device as claimed in claim 1, wherein the lever mechanism comprises a rotatable shaft.

9. The device as claimed in claim 1, wherein the lever mechanism comprises two shafts rotating in opposite directions and provided with mutually coupled cranks.

10. The device as claimed in claim 9, wherein the shafts can be operated by means of a single handle.

11. The device as claimed in claim 1, wherein the transmission ratio of the lever mechanism in the first part of the range of the mutually approaching movement of the first structural part and the second structural part is substantially lower than the transmission ratio in a final part of this range.

12. The device as claimed in claim 1, wherein the lever mechanism comprises for this purpose a cam which is mechanically connected to one of the structural parts and which co-acts with a part, profiled for this purpose, of the surface of the other structural part.

13. The device as claimed in claim 1, further comprising aligning means with which the outer ends of the fluidic conduits and the microfluidic chip can be mutually aligned, wherein the aligning means may be spring-mounted aligning members with balls and recesses co-acting therewith.

14. The device as claimed in claim 1, further comprising a conical receiving space for at least partially receiving a sealing member with a corresponding conical outer surface, and an urging means for urging the sealing member into the conical receiving space, wherein the second urging means may be a spring.

15. The device as claimed in claim 14, further comprising a sealing auxiliary means in which the conical receiving space is arranged.

16. The device as claimed in claim 14, wherein the urging means are biased.

17. A method for fluidic coupling of fluidic
conduits to a microfluidic chip and uncoupling thereof, comprising:
mechanically coupling the fluidic conduits to a first structural part;
having the microfluidic chip carried by a second structural part; and
moving the first structural part and the second structural part perpendicularly toward and away from each other by means of a mechanism provided for this purpose, wherein the first structural part and the second structural part are moved relative to each other by means of a lever mechanism, and
wherein a transmission ratio of the lever mechanism in a first part of a range of a relative movement of the first structural part and the second structural part is chosen so as to be substantially different from a transmission ratio in a second part of the range.

18. The method as claimed in claim 17, further comprising guiding the relative movement of the first structural part and the second structural part by means of guide means provided for this purpose, wherein the guide means may be cylindrical guides and recesses co-acting therewith.

19. The method as claimed in claim 17, further comprising urging apart the first structural part and the second structural part by means of a first urging means, wherein the first urging means may be first springs, provided for this purpose.

20. The method as claimed in claim 17, further comprising placing the microfluidic chip at least partially into a receiving space which is provided for this purpose and which forms part of a removable part which is provided for this purpose and forms part of the second structural part.

21. The method as claimed in claim 20, further comprising holding apart the outer surface of the microfluidic chip and the outer ends of the fluidic conduits during removal or insertion of the removable part by means of protrusions which are arranged for this purpose on the removable part and which, after the microfluidic chip is received in the receiving space, protrude above the surface of the microfluidic chip directed toward the fluidic conduits.

22. The method as claimed in claim 17, wherein the transmission ratio of the lever mechanism in the first part of the range of the mutually approaching movement of the first structural part and the second structural part is chosen so as to be substantially lower than the transmission ratio in a final part of this range.

23. The method as claimed in claim 17, further comprising causing movement of the first structural part and the second structural part relative to each other by co-action of a cam, provided for this purpose and connected mechanically to one of the structural parts, with a part, profiled for this purpose, of the surface of the other structural part.

24. The method as claimed in claim 17, wherein outer ends of the fluidic conduits and the microfluidic chip are mutually aligned by means of an aligning means provided for this purpose, wherein the aligning means may be spring-mounted aligning members, with balls, and recesses co-acting therewith.

25. The method as claimed in claim 17, wherein for the purpose of sealing a connection of the fluidic conduit to the microfluidic chip use is made of a conical receiving space which is provided for this purpose in which a sealing member with a corresponding conical outer surface is at least partially received, wherein the sealing member is urged into the conical receiving space by an urging means provided for this purpose, wherein the second urging means may be a spring.

26. The method as claimed in claim 25, wherein use is made of a sealing auxiliary means in which the conical receiving space is arranged.

27. The method as claimed in claim 25, wherein the urging means are biased.

28. A device for fluidic coupling of fluidic conduits to a microfluidic chip, and uncoupling thereof, comprising:
a first structural part to which the fluidic conduits can be mechanically connected;
a second structural part which can carry the microfluidic chip;
a mechanism with which the first structural part and the second structural part can be moved perpendicularly toward and away from each other;

a conical receiving space for at least partially receiving a sealing member with a corresponding conical outer surface, and an urging means for urging the sealing member into the conical receiving space, wherein the urging means may be a spring; and a sealing auxiliary means in which the conical receiving space is arranged.

* * * * *

UNITED STATES PATENT AND TRADEMARK OFFICE

CERTIFICATE OF CORRECTION

PATENT NO. : 8,522,413 B2
APPLICATION NO. : 12/666497
DATED : September 3, 2013
INVENTOR(S) : Ronny Van't Oever et al.

It is certified that error appears in the above-identified patent and that said Letters Patent is hereby corrected as shown below:

On the title page, Column 1, Item (73) Assignee, Line 1, delete "Microfluids" and insert -- Microfluidics --

In the Claims

Column 6, Line 56, Claim 1, delete "other~" and insert -- other --

Signed and Sealed this
Fourth Day of February, 2014

Michelle K. Lee

Michelle K. Lee
*Deputy Director of the United States Patent and Trademark Office*